United States Patent [19]

Papst

[11] Patent Number: 4,458,644

[45] Date of Patent: Jul. 10, 1984

[54] MOTOR VEHICLE WITH INTERNAL COMBUSTION ENGINE

[76] Inventor: Hermann Papst, Karl-Maier Str. 3, D-7742 St. Georgen, Fed. Rep. of Germany

[21] Appl. No.: 488,253

[22] Filed: Apr. 25, 1983

Related U.S. Application Data

[63] Continuation of Ser. No. 228,507, Jan. 26, 1981, abandoned.

[30] Foreign Application Priority Data

Jan. 24, 1980 [DE] Fed. Rep. of Germany ..... 3003391

[51] Int. Cl.[3] ..... F01M 1/00

[52] U.S. Cl. ..... 123/196 S; 123/196 R; 184/6.3; 184/27 C; 184/27 A

[58] Field of Search ..... 123/196 R, 196 S, 196 CP; 184/6.3, 26, 27 C, 27 A; 60/605

[56] References Cited

U.S. PATENT DOCUMENTS

| | | | |
|---|---|---|---|
| 2,102,514 | 12/1937 | Clarkson | 184/6 |
| 2,747,564 | 5/1956 | Wehling | 123/196 S |
| 2,838,039 | 6/1953 | Smith | 123/196 R |
| 3,295,507 | 1/1967 | Carter | 123/196 R |
| 3,561,565 | 2/1971 | Woor | 123/196 R |
| 4,199,950 | 4/1980 | Hakanson | 184/6.26 |
| 4,303,401 | 12/1981 | Sanmi et al. | 440/88 |
| 4,354,849 | 10/1982 | Sanmi et al. | 440/88 |

FOREIGN PATENT DOCUMENTS

| | | | |
|---|---|---|---|
| 1154974 | 9/1963 | Fed. Rep. of Germany | 123/196 S |
| 2556948 | 6/1977 | Fed. Rep. of Germany | 123/196 R |
| 3002362 | 1/1980 | Fed. Rep. of Germany | 60/605 |
| 874863 | 8/1942 | France | 123/196 S |
| 940909 | 11/1963 | United Kingdom | 123/196 R |

*Primary Examiner*—Charles J. Myhre
*Assistant Examiner*—E. Rollins Cross
*Attorney, Agent, or Firm*—James Creighton Wray

[57] ABSTRACT

A lubricating arrangement for an I.C. engine in which at least one lubricating pump for engine lubrication is activated by a battery-fed electric motor, independent of the I.C. engine, which supplies a preset oil quantity which is unrelated to the rpms of the I.C. engine. As this lubricating pump is driven by a battery-fed electric motor which runs up within a fraction of a second, the I.C. engine is instantly under pressure with a full quantity of lubricating oil.

7 Claims, 2 Drawing Figures

MOTOR VEHICLE WITH INTERNAL COMBUSTION ENGINE

This is a continuation of application Ser. No. 228,507, filed 1/26/81, now abandoned.

The invention relates to a motor vehicle with internal combustion engine, and is based on the realization that the life span of conventional internal combustion engines, as utilized in motor vehicles, is greatly dependent upon stress exerted in the starting process, particularly cold-starting. The partial quantity delivered by the lubricating pumps of the internal combustion engines of conventional design is in proportion to the number of revolutions per minute (rpm) of the internal combustion engine. During the starting procedure of the internal combustion engine, in which it is being activated by the starter, the number of rpms is still very low, resulting in an equally low oil-supply — at that point practically negligible. In a cold start it usually takes some time for the I.C. engine of a motor vehicle to start up, and during this time the I.C. engine is insufficiently lubricated, especially since the oil from the cylinder wall areas, and part of the oil from the bearing areas, has receded into the oil tank when the still hot I.C. engine was last switched off.

The invention has the objective to improve lubrication of I.C. engines by a novel and uncomplicated construction design so that wear can be reduced and effective lifespan extended. This objective is achieved by an arrangement for lubricating I.C. engines of the kind specified above, in which at least one lubricating pump for engine lubrication is activated by a battery-fed electric motor, independent of the I.C. engine, which supplies a preset oil quantity which is unrelated to the rpms of the I.C. engine. As this lubricating pump is driven by a battery-fed electric motor which runs up within a fraction of a second, the I.C. engine is instantly supplied, under pressure, with a full quantity of lubricating oil.

Due to the fact that the battery-fed electric motor attains its full speed in a very short time, and inherently the oil pump powered by it quickly supplies the entire prescribed quantity of oil, it is ensured that upon starting the I.C. engine, all areas to be provided with lubricating oil receive an adequate oil supply. It is advantageous to couple the switch for activation of the electric motor powering the lubricating pump with the device for starting the I.C. engine in such a manner that upon switching on the ignition, or at the latest, upon engaging the starter of the I.C. engine, the electric motor operating the lubricating pump, is started simultaneously. If the I.C. engine has an ignition arrangement with a pre-ignition fuse, according to German Pat. No. 1,476,651, it is advantageous to turn on the electric motor powering the lubricating pump and the selector switch for heating the pre-ignition fuse (glow plugs) simultaneously.

In the conventional coupling of a lubricating pump with the I.C. engine, a relatively large quantity of lubricating oil is supplied to the I.C. engine upon reaching higher speeds. This results not only in increased oil consumption due to bubble formation and oxidation, but also results in unnecessarily high energy consumption for the lubricating pump. These disadvantages can be avoided by the above-mentioned powering of the lubricating pump by a battery-fed electric motor. Moreover, an extended usage of the lubricating oil is achieved, as now no surplus quantities of lubricating oil are being sent through the I.C. engine, where they would be oxidized. A determination as to when the preset number of rpms of the I.C. engine is exceeded and the electric motor is to be switched off, should take into account the amount of voltage supplied by the generator coupled to the I.C. engine.

Up to this time, too much oil frequently was supplied to the I.C. engine when it was operated at higher rpms. The means described above eliminate this disadvantage while also providing that no current is taken from the battery for operation of the electric motor, inherently reducing the stress on the battery.

Further embodiments and possible variations of the invention are described in the dependent claims and are subsequently set forth in connection with the examples in the drawings. In the schematically simplified drawings, corresponding parts are designated with corresponding reference numerals.

Figure 1:
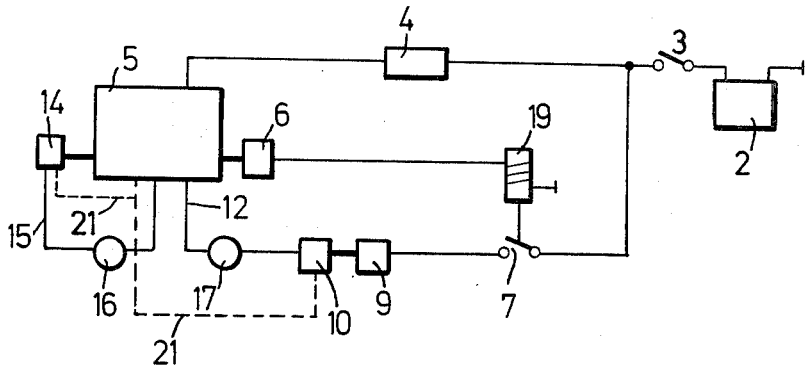
FIG. 1 is an example of the invention

The arrangement depicted schematically in FIG. 1 only shows those parts, oil lines and electrical lines, necessary for basic understanding of the invention - all other parts and lines have been eliminated in the interest of a clearer overview.

Battery 2 is connected electrically with ignition device 4 of the I.C. engine via ignition switch 3. I.C. engine 5 is mechanically coupled with generator 6 which charges battery 2 in conventional manner, by means of relays not depicted.

When engaging the ignition by closing of ignition switch 3, direct-current shunt motor 9, operating a first lubricating pump 10, is also activated via switch 7 which is closed in the state of quiescence.

I.C. engine 5 is also mechanically connected with a second lubricating pump 14 which supplies a quantity of oil which is proportionate to the rpm of the I.C. engine, to the points of lubrication, via line 15 and check valve 16. As soon as a prescribed value is attained by the rpm of the engine, or the voltage generated at the outlet of generator 6 has reached a preset value, relay 19 is tripped which opens switch 7 so that electric motor 9, operating the first lubricating pump 10, is switched off. Thus, at this provided minimum rpm of I.C. engine 5, the lubricating oil supply is exlusively handled by second lubricating pump 14.

In the interest of clarity, FIG. 1 symbolically depicts lubricating pump 14 which is activated by the I.C. engined mounted on the outside of the engine. Ordinarily, however, the lubricating pump is an integral part of the I.C. engine. The oil pan of the I.C. engine, not designated, serves as a lubricating oil container or lubricating oil storage container which is connected to lubricating pumps 10 and 14 via lubricating lines 21, depicted by dotted lines.

Figure 2:
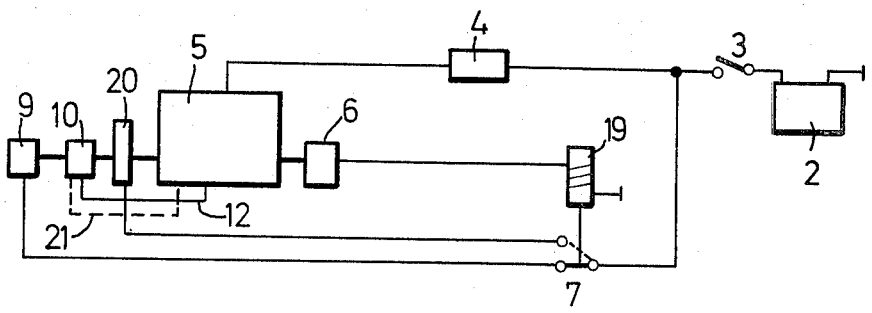
FIG. 2 is a variation of an arrangement depicted in FIG. 1.

FIG. 2 shows another variation of the inventive design in which there is only one lubricating pump 10, which may be powered either by associated electric motor 9 or by way of clutch 20, which can be selectively turned on or turned off, by I.C. engine 5.

As soon as ignition lock 3 is turned on, the battery not only supplies current to ignition device 4, but also supplies current to driving motor 9 of lubricating pump 14 via switch 7 closed in the quiescent position. This means that lubricant in sufficient quantity is supplied instantly upon engaging the ignition, to the I.C. engine already via hydraulic line 12.

Generator 6 is mechanically connected to I.C. engine 5. As soon as the current generated by generator 6 has reached a preset value after starting I.C. engine 5, relay 19 is adequately energized and subsequently switch 7 is transposed from the position depicted in the drawing to the position designated by dotted lines causing electromagnetic clutch 20 to be activated. This is turn separates electric motor 9 from battery 2 while the generator activates lubricating pump 10 via clutch 20, proportionate to the rpm of the I.C. engine.

The present invention for the first time greatly improves an I.C. engine in that the oil pressure desired at the lubricating points is already attained at the time of starting the motor, i.e. considerable wear during cold-starting, experienced heretofore, is practically eliminated or greatly reduced. Further, the oil quantity at higher rpms can be adapted in an ideal manner to the specific requirements of the respective design of an I.C. engine. Consequently, either a preset minimum amount of lubricant may be supplied as a continous quantity, or, above a predetermined number of rpm, the I.C. engine can be supplied with an oil quantity increasing in proportion with the rising rpms.

This novel lubricating arrangement for I.C. engines results in a significant extended life span of the rather costly I.C. engine at relatively small expense and represents a major cost factor when applied to motor vehicles considering that the mere cost of replacing an I.C. engine would even be substantially increased by the expense of removing the worn I.C. engine and installation of a new or reconditioned one.

I claim:

1. Motor vehicle with an internal combustion engine, characterized in that for lubricating the internal combustion engine, at least one lubricating pump is powered by a battery-fed electric motor, independent of the internal combustion engine, which supplies a preset oil quantity which is unrelated to the revolutions per minute of the internal combustion engine, said electric motor powering the lubricating pump being coupled with a device for activating or starting the internal combustion engine in such a way that upon turning on a selector switch, an ignition, or a starter, respectively, the electric motor powering the lubricating pump is simultaneously switched on.

2. Motor vehicle according to claim 1 characterized by an interrelationship of the electric motor powering the lubricating pump with the internal combustion engine in such a way that upon the internal combustion engine surpassing a minimum revolutions per minute, the electric motor powering the lubricating pump is turned off, and the supply of lubricating oil to the internal combustion engine is provided by a lubricating pump coupled to the internal combustion engine.

3. Motor vehicle according to claim 1 characterized in that additionally to a lubricating pump supplying an increasing oil quantity as the rpm of the internal combustion engine is increased, there is a lubricating pump powered by an electric motor, and in that both lubricating pumps feed the lubricating oil supply lines to the lubricating points, and further, that in at least one, but preferably both hydraulic lines branching off from the mentioned lubricating pumps, there is a built-in check valve, preventing a flow-back of the lubricating oil to the associated lubricating pump.

4. Motor vehicle according to claim 1, characterized in that upon surpassing a predetermined rpm of the internal combustion engine, the rpm of the lubricating pump is being increased proportionately.

5. Motor vehicle according to claim 1, characterized in that the electric motor is designated as a shunt motor.

6. Motor vehicle according to claim 1, characterized in that the electric motor has a field generated by at least one permanent magnet.

7. Motor vehicle according to claim 1, characterized in that the internal combustion engine has an ignition arrangement with a preignition switch and in that fuel, is injected immediately after a first compression in a pulsed manner.

* * * * *